US007506385B2

(12) United States Patent
Werschmidt

(10) Patent No.: US 7,506,385 B2
(45) Date of Patent: Mar. 24, 2009

(54) SUBMERSING BATHING AND TRANSFER CHAIR

(75) Inventor: Gary S. Werschmidt, Yorba Linda, CA (US)

(73) Assignee: Columbia Medical Manufacturing, LLC, Santa Fe Springs, CA (US)

( * ) Notice: Subject to any disclaimer, the term of this patent is extended or adjusted under 35 U.S.C. 154(b) by 484 days.

(21) Appl. No.: 11/252,961

(22) Filed: Oct. 18, 2005

(65) Prior Publication Data

US 2007/0083990 A1 Apr. 19, 2007

(51) Int. Cl.
*A47K 3/02* (2006.01)

(52) U.S. Cl. ..... 4/561.1

(58) Field of Classification Search ..... 4/480, 4/560.1–563.1, 578.1
See application file for complete search history.

(56) References Cited

U.S. PATENT DOCUMENTS

| | | | |
|---|---|---|---|
| 131,419 | A | 9/1872 | Black |
| 364,053 | A | 5/1887 | Skau |
| 469,569 | A | 2/1892 | Hogan |
| 1,188,534 | A | 6/1916 | Corwin |
| 1,190,523 | A | 7/1916 | Dodd |
| 1,386,612 | A | 9/1921 | Farah |
| 2,040,942 | A | 5/1936 | Katenkamp |
| 2,911,245 | A | 11/1959 | Kurz |
| 3,123,398 | A | 3/1964 | Murcott |
| 3,290,090 | A | 12/1966 | Ford |
| 3,352,580 | A | 11/1967 | Kurz et al. |
| 3,832,740 | A | 9/1974 | McClarrin |
| 3,835,483 | A | 9/1974 | Emery et al. |
| 3,840,268 | A | 10/1974 | Johndrow et al. |
| 3,918,822 | A | 11/1975 | Rauschenberger |
| 3,994,030 | A | 11/1976 | Cassell et al. |
| 4,058,341 | A | 11/1977 | Prins |
| 4,140,065 | A | 2/1979 | Chacon |
| 4,150,445 | A | 4/1979 | Bailey |
| 4,166,297 | A | 9/1979 | Saleeby |
| 4,266,306 | A | 5/1981 | Lee |
| 4,295,683 | A | 10/1981 | Dubbink et al. |
| 4,354,710 | A | 10/1982 | Rauschenberger |
| 4,391,006 | A | 7/1983 | Smith |
| 4,472,844 | A | 9/1984 | Mace |
| 4,544,178 | A | 10/1985 | Al-Sheikh et al. |
| 4,574,409 | A | 3/1986 | McAffrey |

(Continued)

FOREIGN PATENT DOCUMENTS

| | | | |
|---|---|---|---|
| JP | 406339508 | * 12/1994 | ..... 4/561.1 |

*Primary Examiner*—Charles E Phillips
(74) *Attorney, Agent, or Firm*—Paul M. Thompson; Cochran Freund & Young LLC

(57) ABSTRACT

Disclosed is an apparatus for a bathing and transfer chair that provides a stand alone wheeled chair that is configurable to engage a stand alone base, adapted to engage a bathing tub and lower the level of the chair thereby submersing the user in the bath water. The seat portion of the device is adaptable to transfer an individual from the wheeled chair portion of the device, positioned outside of the bathing area, to the submersing base which is positioned within the bathing area. The described embodiments can be custom fit to individual's dimensions, or be refit at any time to accommodate growth and/or size changes. Legs, calf support and back angles as well as chair height can be adjusted independently to maximize positioning options to accommodate the support and comfort of the user.

38 Claims, 8 Drawing Sheets

U.S. PATENT DOCUMENTS

| | | | |
|---|---|---|---|
| 4,596,241 | A | 6/1986 | Neudorfer |
| 4,894,877 | A | 1/1990 | Marsh |
| 5,097,542 | A | 3/1992 | Roesler |
| 5,103,509 | A | 4/1992 | Richards |
| D330,461 | S | 10/1992 | Stevens |
| 5,157,797 | A | 10/1992 | Forwick |
| 5,185,892 | A | 2/1993 | Mitchell |
| 5,226,183 | A | 7/1993 | Clark |
| 5,246,265 | A | 9/1993 | Nagen et al. |
| 5,335,377 | A | 8/1994 | Masayada et al. |
| 5,341,525 | A | 8/1994 | Tillman et al. |
| 5,377,366 | A | 1/1995 | Boyd et al. |
| 5,393,119 | A | 2/1995 | Mukal |
| D355,985 | S | 3/1995 | Karten et al. |
| 5,412,817 | A | 5/1995 | Smith |
| D360,022 | S | 7/1995 | Smith |
| 5,467,486 | A | 11/1995 | Guenther |
| 5,498,054 | A | 3/1996 | Tomlinson |
| 5,517,704 | A | 5/1996 | Dagostino |
| 5,520,435 | A | 5/1996 | Fujimoto et al. |
| 5,535,458 | A | 7/1996 | Siverly |
| 5,682,626 | A | 11/1997 | Banks, Jr. et al. |
| D389,099 | S | 1/1998 | McKay |
| 5,715,545 | A | 2/1998 | Forwick |
| 5,822,809 | A | 10/1998 | Gallo |
| 5,937,454 | A | 8/1999 | Drew |
| 5,953,769 | A | 9/1999 | Williams |
| 5,988,755 | A | 11/1999 | Fastelli et al. |
| 5,996,139 | A | 12/1999 | Gesse |
| 6,012,769 | A | 1/2000 | Hsueh et al. |
| 6,088,847 | A | 7/2000 | Burrow |
| 6,094,756 | A | 8/2000 | Carter |
| 6,122,776 | A | 9/2000 | Cheng |
| 6,158,809 | A | 12/2000 | Gobbers et al. |
| 6,164,722 | A | 12/2000 | Mabey |
| 6,199,226 | B1 | 3/2001 | Steadman |
| D439,869 | S | 4/2001 | Kjell et al. |
| 6,226,809 | B1 | 5/2001 | Davies |
| 6,297,178 | B1 | 8/2001 | Hill |
| 6,334,225 | B1 | 1/2002 | Brinkmann |
| 6,351,680 | B1 | 3/2002 | Schaffer |
| 6,381,772 | B1 | 5/2002 | Dawson |
| 6,397,409 | B1 | 6/2002 | Sherlock et al. |
| 6,408,456 | B1 | 6/2002 | Fike et al. |
| 6,941,592 | B1 * | 9/2005 | Castillo ..... 4/560.1 |

* cited by examiner

SUBMERSING BATHING AND TRANSFER CHAIR

BACKGROUND OF THE INVENTION

1. Field of the Invention

The present invention relates to chairs and more specifically to a submersing shower/commode chair.

2. Description of the Background

Numerous bathing and transfer chairs or benches have been developed to assist persons with limited mobility or physical ability within a bathing enclosure such as a bathtub, shower, whirlpool or the like. These include devices that act as a seat, bench or stool supported by the base or edge of the enclosure. Others include apparatus that are used as a rotatable seat to facilitate transfer of an individual (especially from a wheelchair) to a bathing enclosure and are often combined with a track unit that allows the seat to translate from a position outside the parameter of the tub to the inside. These designs are lacking in many ways, including the inability of the designs to adjust to a variety of precise positions to accommodate the support and transfer of the user. Additionally, most bathing transfer chairs lack the ability to transfer individuals into the bathing water in an easy and safe manner for both the user and/or an assistant.

SUMMARY OF THE INVENTION

An embodiment of the present invention may therefore comprise a bathing and transfer chair for an individual comprising: a base assembly comprising a rigid structural base frame that supports at least one chair support rail; a submersing bench assembly comprising a rigid structural bench frame that supports at least one bench support rail, the submersing bench assembly that is mechanically adapted to couple with the base assembly such that the chair support rail align coaxially with the bench support rail to create a glide track; a chair assembly adapted to support an individual that can traverse the glide track between the base assembly and the submersing bench assembly; and, the submersing bench assembly that can be manipulated to lower the level of the chair assembly into a bathing tub.

An embodiment of the present invention may also comprise a bathing and transfer chair for an individual comprising: a wheeled base assembly comprising a rigid structural base frame and at least one chair support rail, the base frame that is supported by at least three wheeled legs; a submersing bench assembly comprising a rigid structural bench frame and at least one bench support rail, the bench frame that is supported by at least one leg, the submersing bench assembly that is mechanically adapted to couple with the wheeled base assembly such that the chair support rails align coaxially with the bench support rails to create a glide track; a chair assembly adapted to support an individual that may independently rest upon the wheeled base assembly or the submersing bench assembly, the chair assembly that can traverse the glide track between the wheeled base assembly and the submersing bench assembly; and, the submersing bench assembly that can be manipulated to lower the level of the chair assembly.

DETAILED DESCRIPTION OF THE INVENTION

Figure 1:
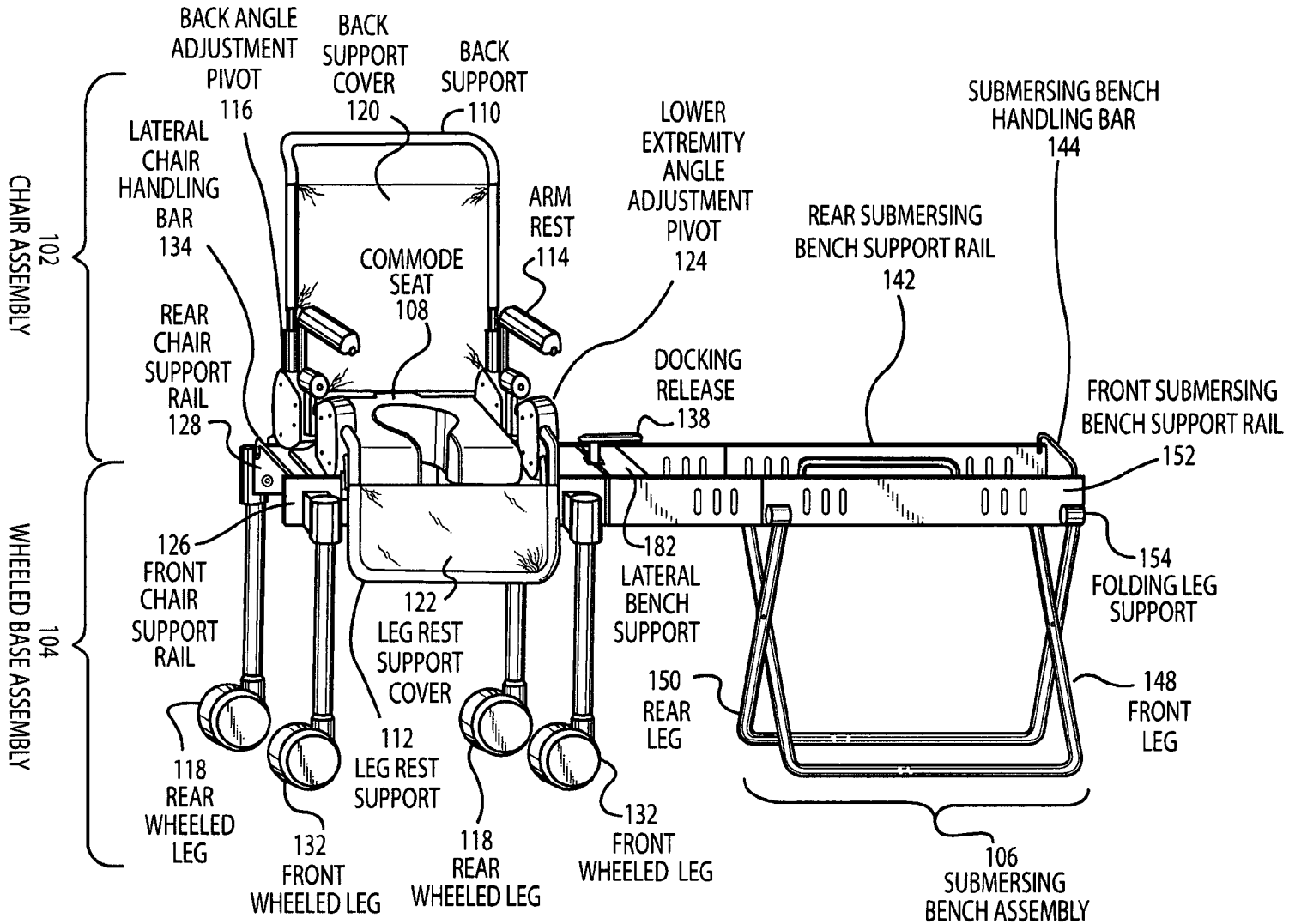
FIG. 1 is a drawing showing an embodiment of a submersing bathing and transfer chair.

While this invention is susceptible to embodiment in many different forms, there is shown in the drawings and will be described herein in detail specific embodiments thereof with the understanding that the present disclosure is to be considered as an exemplification of the principles of the invention and is not to be limited to the specific embodiments described.

FIG. 1 is a drawing showing an isometric view of an embodiment of a submersing bathing and transfer chair with an actuated submersing bench assembly. The seat portion of the device is adaptable to transfer an individual from the wheeled chair portion of the device (outside of the bathing area) to the legged base, which is positioned within the bathing area and has the ability to then be positioned to a lower level within the bathing tub. The described embodiments can be custom fit to an individual's dimensions, or be refit at any time to accommodate growth and/or size changes. Legs, calf support and back angles as well as chair height can be adjusted independently to maximize positioning options to accommodate the support and comfort of the user.

As illustrated in FIG. 1, a chair assembly 102 comprising a commode seat 108 is supported within a tubular frame assembly. A back support 110 provides a tubular perimeter by which a back support cover 120 is attached to provide a support for the user's back. Similarly, a leg rest support 112 provides a tubular perimeter by which a leg rest support cover 122 is attached to provide a support for the user's legs. On either rear lateral side of the commode seat 108, a back angle adjustment pivot 116 is used to receive the back support 110 and thereby set and adjust the upper torso angle of the user. On either front lateral side of the commode seat 108, a lower extremity angle adjustment pivot 124 is used to receive the leg rest support 112 and adjust the lower extremity angle of the user. The back angle adjustment pivot 116 and the lower extremity angle adjustment pivot 124 are rigidly fixed with respect to the seat chassis as well as being fixed as left and right pairs by lateral chair stabilizing bars (not shown) which also support an armrest 114 on both left and right side. Each armrest 114 can be mounted so that it may pivot or fold such that allows easy access of the user to the chair.

The chair assembly includes front and rear glide rails (not shown) to rest upon and glide between a lower base portion. This base portion can be either the wheeled base assembly 104 or the submersing bench assembly 106. The wheeled base assembly 104 supports the glide rails of the chair assembly 102 with a front chair support rail 126 and a rear chair support rail 128. The front and rear chair support rails 126-128 are rigidly fixed with respect to one another by a lateral base support (not shown) on the mating side and by a chair handling bar 134 on the opposing side. The front chair support rail 126 provides a mounting point for a pair of front wheeled legs 132 and the rear chair support rail 128 provides a mounting point for a pair of rear wheeled legs 112. The height of these wheeled chair legs may be adjustable in any variety of methods such as telescoping rods, multiple set pin placements or the like. As a stand alone device, the combination of the chair assembly 102 and wheeled base assembly 104 provide an independent and stable platform as a mobile shower chair, a commode chair or a mobile transport device for the user. The aforementioned chair support rails 126-128 are depicted within FIG. 1 as thin bars, but it is within the scope of the invention that the rails may also take the form of a much wider stature in the horizontal plane such that the "bar" geometry may take on a more "plate-like" or platform shape.

The wheeled base assembly 104 is shown in FIG. 1 as being docked with a submersing bench assembly 106 with a mating interface of a lateral bench support 182. The submersing bench assembly 106 comprises a front submersing bench support rail 152 and a rear submersing bench support rail 142 that are similar in function and geometry to the front and rear chair support rails 126-128. The front submersing bench support rail 152 and a rear submersing bench support rail 142 are rigidly fixed in position to one another by a bench lateral support 182 on the docking end and by a submersing bench handling bar 144 on the opposing end. In this embodiment, a pair of rear legs 150 and front legs 148 are formed in a "U" shaped manner with the bottom portions of the "U" supporting the weight of the front and rear submersing bench support rails 152 and 142 by an attachment at the upper ends at folding leg supports 154. The rear legs 150 and front legs 148 are crossed front to back on each lateral side and are attached to one another by a sliding pivot (detailed in FIG. 5). The support acts similar to a scissors and allows the entire submersing bench assembly 106 to be lowered.

The height of the submersing bench assembly 106 may be lowered in any variety of methods such as a ratcheting or screw mechanism acting like a jack or can be actuated with a pneumatic or hydraulic cylinder or even a motor driven actuator. This height adjustment may be performed manually or automatically with a mechanism controlled by a sensor to produce an auto-leveling feature for the submersing bathing and transfer chair. Special care and precaution must be exercised if any type of electrical mechanism or controller is utilized in conjunction with the chair due to the safety concerns dealing with electrical current and a person submerged in water. The embodiment as in depicted FIG. 1, allows for the translation of distance between the supporting portions of the front leg and the rear leg assemblies 148, 150 to be realized as an adjustment in height of the front and rear submersing the bench support rails 142, 152.

When the bathing and transfer chair is in a docked condition, as depicted in FIG. 1, the front chair support rail 126 of the wheeled base assembly 104 aligns and mates with the lateral bench support 182 and the front submersing bench support rail 152 of the submersing bench assembly 106 to provide a continuous support path for a front chair glide rail on the chair assembly 102 to traverse from one side of the apparatus to the other. Similarly, the rear chair support rail 128 of the wheeled base assembly 104 aligns and mates with the lateral bench support 182 and the rear submersing bench support rail 142 of the submersing bench assembly 106 to provide a substantially continuous support path for a rear chair glide rail on the chair assembly 102 to traverse from one side of the apparatus to the other. This alignment allows the chair assembly 102 to likewise traverse between the wheeled base assembly 104 to the submersing bench assembly 106 and back. Any variety of means may be used to assist an easy transfer motion of the chair assembly 102 between the wheeled base assembly 104 and the submersing bench assembly 106 such as rollers, bearings, friction glides or the like. A docking release 138 is positioned on the lateral bench support 182 near a separation line between the wheeled base assembly 104 the submersing bench assembly 106 to facilitate separation of the device and lock out movement of the chair assembly 102 when the base portions are not properly connected.

Figure 2:
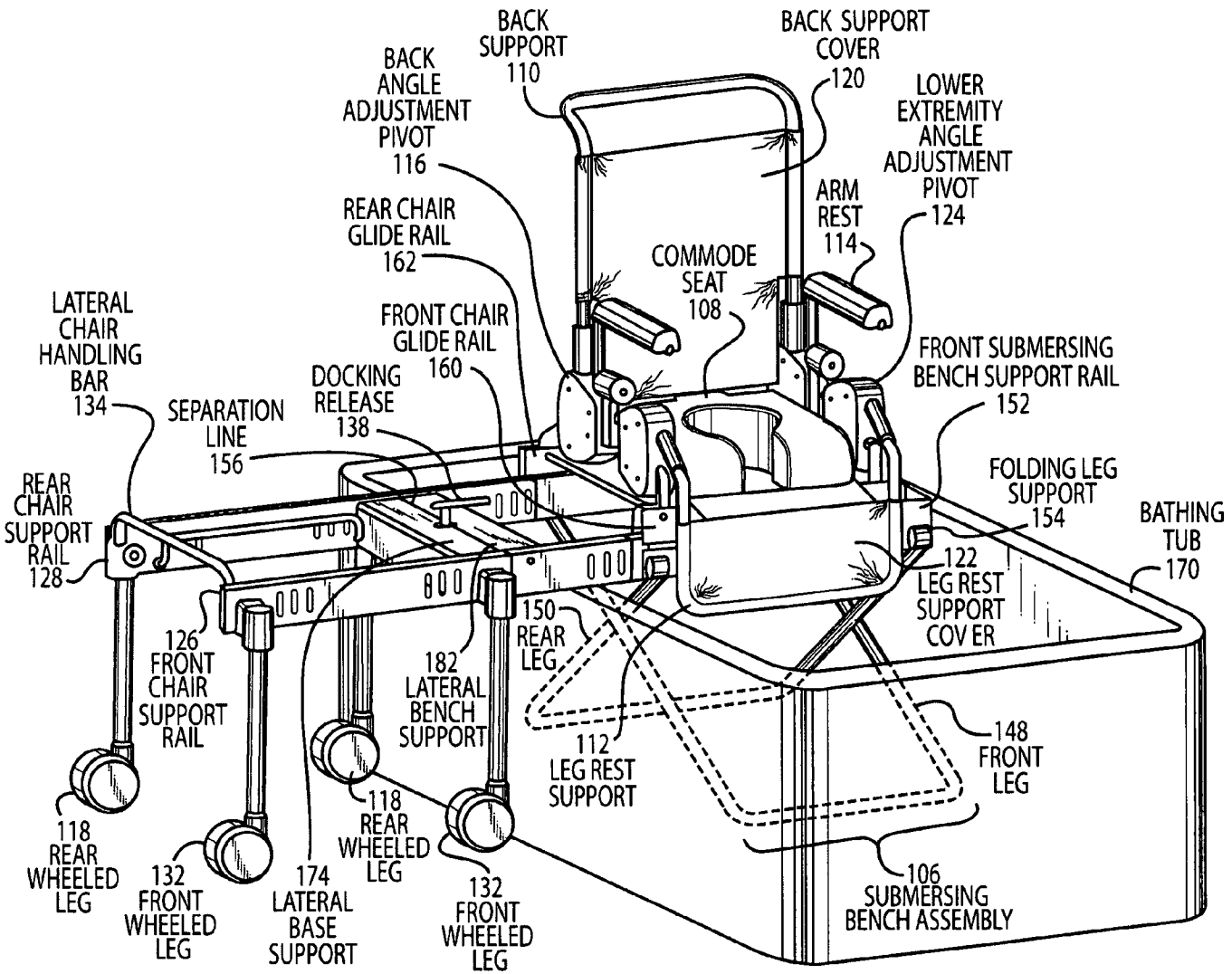
FIG. 2 is a drawing showing an embodiment of a submersing bathing and transfer chair in a bathtub application.

FIG. 2 is a drawing showing an embodiment of a submersing bathing and transfer chair in a bathtub application. As similarly shown in FIG. 1, a chair assembly 102 comprises a commode seat 108, a back support 110 covered by a back support cover 120, and a leg rest support 112 covered by a leg rest support cover 122, with a back angle adjustment pivot 116 on either rear lateral side of the commode seat 108. On either front lateral side of the commode seat 108, a lower extremity angle adjustment pivot 124 is used to receive the leg rest support 112. The back angle adjustment pivot 116 and the lower extremity angle adjustment pivot 124 are rigidly fixed with respect to the seat chassis as well as fixed as left and right pairs by lateral chair stabilizing bars (not shown) which also support an armrest 114 on both left and right side.

The chair assembly 102 is positioned with respect to the base members by translation on a front glide rail 160 and a rear glide rail 162. This base member can be either the wheeled base assembly 104 or the submersing bench assembly 106. The wheeled base assembly 104 supports the glide rails 160 and 162 of the chair assembly 102 with a front chair support rail 126 and a rear chair support rail 128. The front and rear chair support rails 126 and 128 are rigidly fixed with respect to one another by a lateral base support 174 on the mating side and by a lateral chair handling bar 134 on the opposing side.

The wheeled base assembly 104 is shown in FIG. 2 as being docked with a submersing bench assembly 106 with the chair assembly 102 positioned over a bathing tub 170. A set of four submersing bench legs are mounted to the front and rear submersing bench support rails 152 and 142 and are positioned inside the bathing tub 170 resting on a tub floor surface. The submersing bench legs are joined on the bottom in pairs of front legs 148 and rear legs 150 and attached to the front and rear submersing bench support rails 152 and 142 with a folding leg support.

When the bathing and transfer chair is in a docked condition, as depicted in FIG. 1, the front chair support rail 126 of the wheeled base assembly 104 aligns and mates with the front submersing bench support rail 152 of the submersing bench assembly 106 with the assistance of the lateral bench support 182 acting to provide a continuous support path for a front chair glide rail on the chair assembly 102 to traverse from one side of the apparatus to the other. Similarly, the rear chair support rail 128 of the wheeled base assembly 104 aligns and mates with the rear submersing bench support rail 142 of the submersing bench assembly 106 with the assistance of the lateral bench support 182 acting to provide a continuous support path for a rear chair glide rail on the chair assembly 102 to traverse from one side of the apparatus to the other. This alignment allows the chair assembly 102 to likewise traverse between the wheeled base assembly 104 to the submersing bench assembly 106 and back. The chair assembly may utilize any number of methods to facilitate the transfer of the chair from one side to another such as wheels, a low friction slide, ball bearings or the like.

Figure 3:
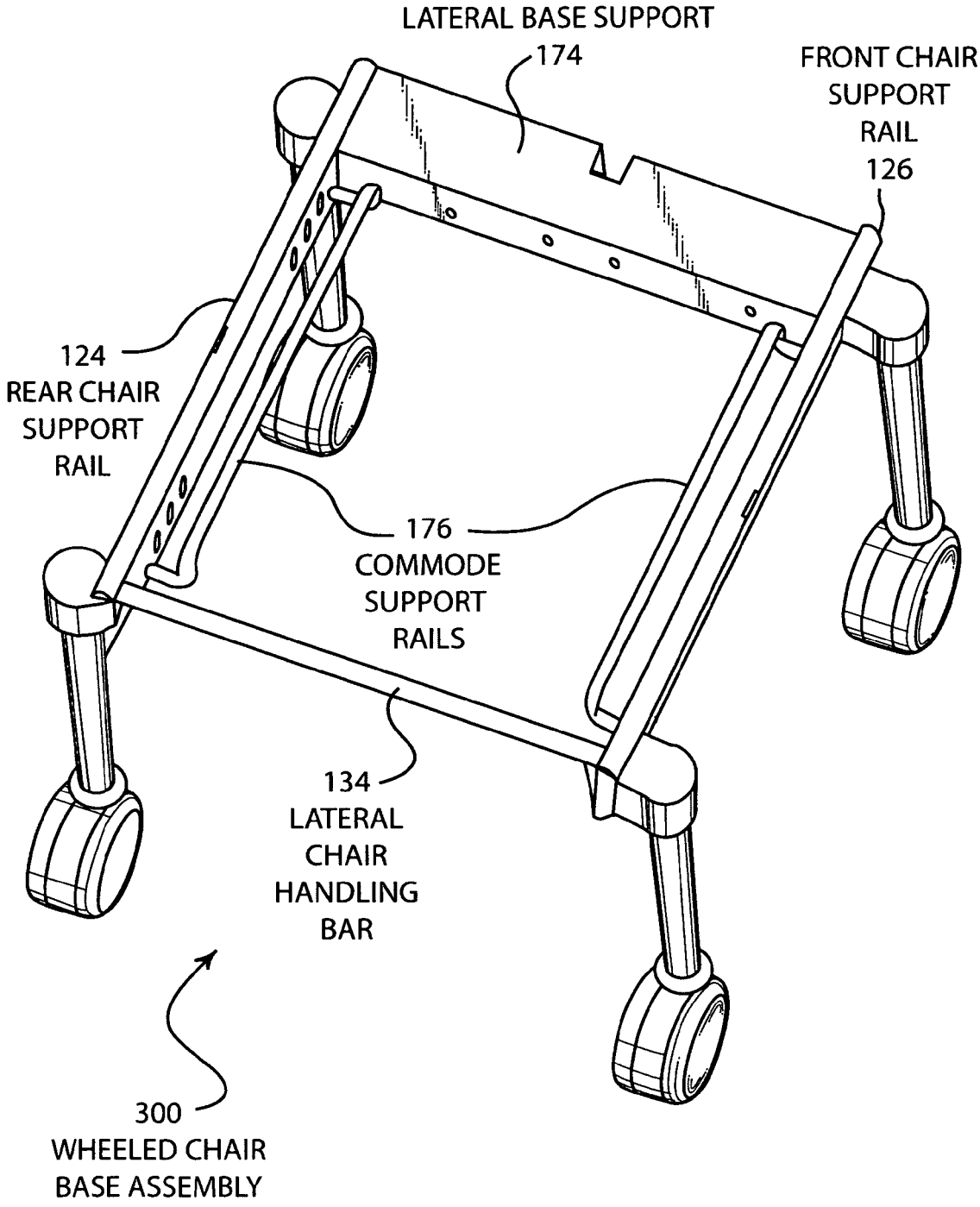
FIG. 3 is a drawing showing an embodiment of a wheeled chair base assembly of a submersing bathing and transfer chair.

FIG. 3 is a drawing showing an embodiment of a wheeled chair base assembly 300 of a submersing bathing and transfer chair. As similarly depicted in FIGS. 1 and 2, the wheeled chair base assembly 100 comprises a front chair support rail 126 and a rear chair support rail 124 connected in an approximately parallel manner to one another by a lateral base support 174 in one side (docking side) and a chair handling bar 134 on the opposing side, thereby creating a rigid structural frame. The front chair support rail 126 and a rear chair support rail 124 create a glide track by which a chair assembly (102 of FIG. 1) can easily be supported and traverse when the two base units (wheeled base assembly 100 and submersing bench assembly 106 of FIG. 1) are docked. At the approximate vicinity of each corner of the structural frame, a wheeled leg is positioned to provide elevation and mobility to the frame. Commode pail support rails 176 are positioned in the interior surface of the structural frame on the front and rear chair support rails 124 and 126 to facilitate a commode pail (not shown) when needed.

Figure 4:
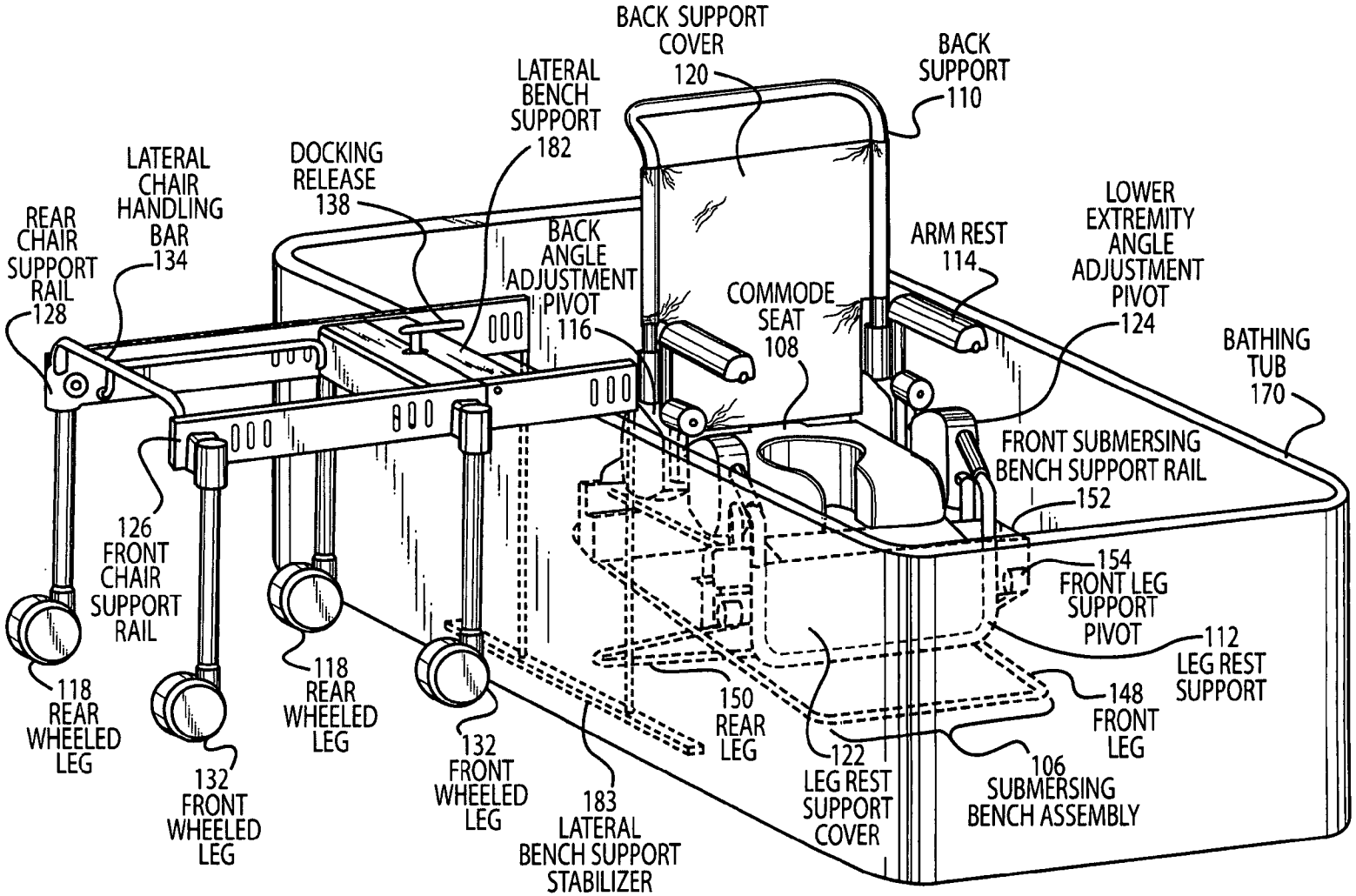
FIG. 4 is a drawing showing an embodiment of a submersing bathing and transfer chair with an actuated submersing bench assembly.

FIG. 4 is a drawing showing an embodiment of a submersing bathing and transfer chair in a bathtub application. As similarly shown in FIG. 2, a chair assembly 102 is shown lowered into bathing tub 170 allowing a user to sit comfortably submerged in the water. Lateral bench support 182 is held in position by a lateral bench support stabilizer 183 which allows the removal of the wheeled base assembly 104 from the lateral bench support 182 while the submerging base assembly 106 is in a lowered position. In this embodiment front leg 148 and rear leg 150 have lowered the height of the front and rear submersing bench support rails 142, 152 in a scissor-like action while maintaining an approximate horizontal orientation of the chair assembly 102.

Figure 5:
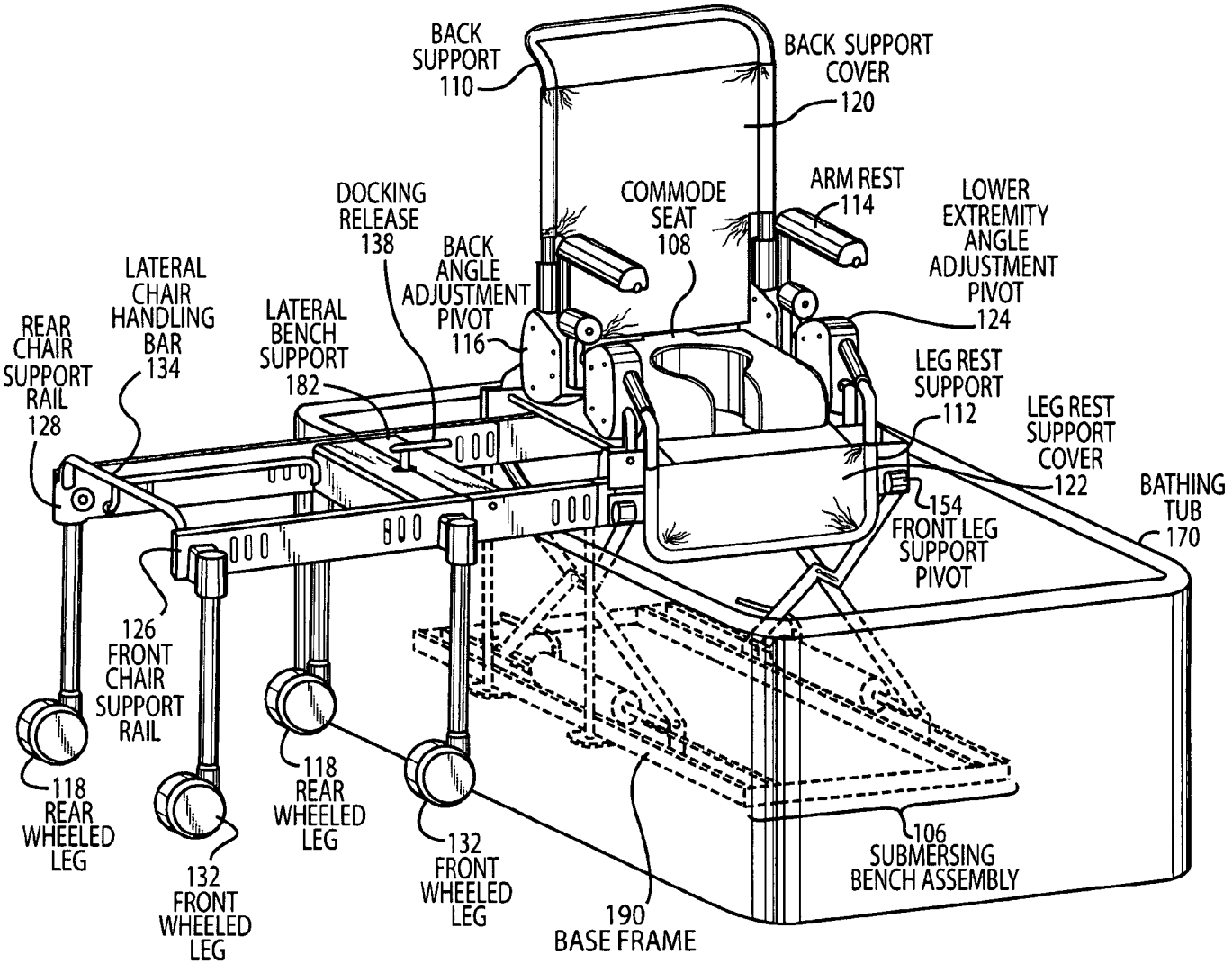
FIG. 5 is a drawing showing an embodiment of a submersing bathing and transfer chair.

FIG. 5 is a drawing showing an embodiment of a submersing bathing and transfer chair in a bathtub application. As similarly shown in FIG. 2, a chair assembly 102 is shown supported by a submersing bench assembly 106. In this particular embodiment, the submersing bench assembly 106 comprises a base frame 190 which is a rigid rectangular frame that rests on the floor of the bathing tub 170 and supports the lower ends of the front and rear legs 148 and 150. The rear legs 150 are each rigidly fixed to a rearward portion of the lateral members of the base frame 190, while the front legs 148 are allowed to traverse front-to-back along a forward portion of the lateral members of the base frame 190. In this manner the height of the submersing bench assembly 106 may be adjusted by adjusting the relative position of the front legs 148 at their base, and an upward and downward translation of chair height can be accomplished in a simple variation in leg position of two or more of the legs.

The submersing bench assembly 106 is configured to dock with the lateral bench support 182 which is configured to dock with the wheeled base assembly 104. Protruding alignment cones and/or safety release activators (not shown) may be utilized to assist the alignment of corresponding indentations on the opposing mating surfaces and thereby aid in properly engaging the various assemblies. When the alignment cones and/or safety release activators are positioned correctly, and the submersing bench assembly 106 is docked with lateral bench support 108 and the wheeled base assembly 104, the units may be held together with a latch and released with a docking release lever 138. In this manner an auto alignment of the base and bench assemblies is achieved because the mating parts within the lateral bench support guide the base and bench assemblies into alignment.

The device is configured to allow the chair assembly to traverse between the wheeled base assembly 104 to the submersing bench assembly, only when both assemblies are present and properly docked, thus preventing the chair from being transferred in an unsafe condition. With this safety release mechanism being activated when the base and bench portions are attached together properly, the chair assembly is prevented from sliding off the wheeled base 104 or submersing bench 106 accidentally causing a user to fall.

Figure 6:
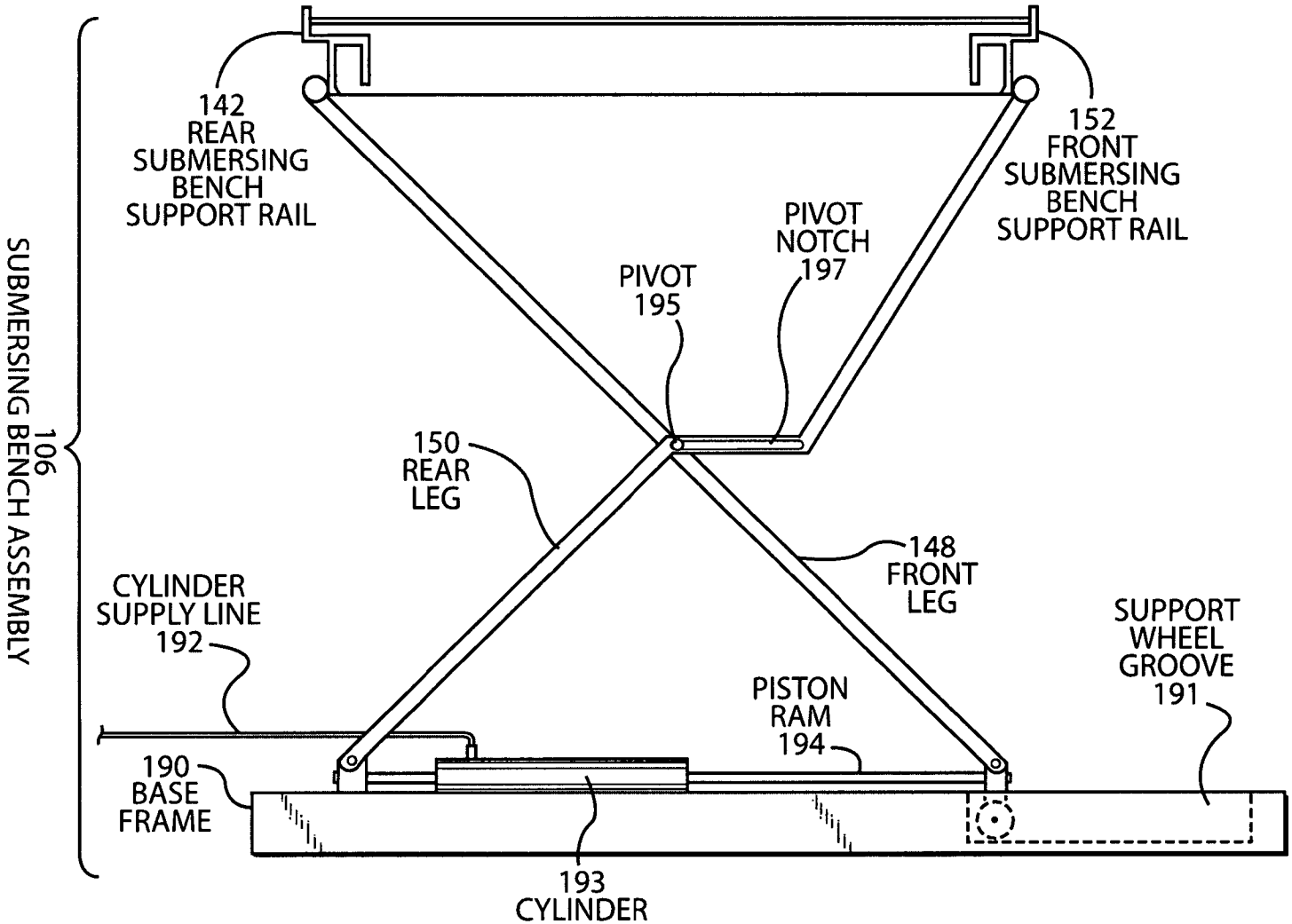
FIG. 6 is a drawing showing an embodiment of a submersing bench assembly for a submersing bathing and transfer chair.

FIG. 6 is a drawing showing an embodiment of a submersing bench assembly 106 for a submersing bathing and transfer chair. The submersing bench assembly 106 comprises a base frame 190 which is a rigid rectangular frame that rests on the floor of the bathing tub 170 and supports the lower ends of the front and rear legs 148 and 150. As shown in FIG. 6, the lower ends of each rear leg 150 are rigidly hinged to a rearward portion of lateral members of the base frame 190 and the upper portion of each rear leg 150 is pivotally connected to the front submersing bench supporter rail 152. The lower ends of the front legs 148 are allowed to traverse front-to-back upon a rolling or sliding mechanism (in this embodiment a wheel 196). The support wheel 196 rolls within a support wheel groove 192 that is located within a forward portion of the lateral members of the base frame 190. The support wheel groove 192 restricts the motion of the front leg 148 to a linear translation that is coplanar to the lateral member of the base frame 190 and sets minimum and maximum limits to the amount of translation available to front leg 148. The upper portion of each front leg 148 is similarly pivotally connected to the rear submersing bench supporter rail 142.

Front and rear legs 148, 150 regulate the height of the front and rear submersing bench support rails 142, 152 in a scissor-like action while maintaining an approximately horizontal orientation of the chair assembly 102 and can be further stabilized by utilizing a pivot 195 connector at the intersection (overlap) point of the front and rear legs 148, 150. In this particular embodiment, it is necessary for the intersection point of the front and rear legs 148, 150 to vary, allowing proper translational movement of the front and rear submerging bench rails 142, 152. This may be accomplished for instance, by rigidly attaching one end of the pivot 195 to the front leg 148 and allowing the other end of the pivot 195 to translate within a pivot groove 197 positioned on the rear leg 150. In order for the submerging bench rails, and subsequently, for the chair assembly 102 to remain level, the pivot groove 197 may be positioned in an approximately horizontal orientation (parallel to the lateral base frame member 190). This can be accomplished by shaping the rear leg 150 to extend at an angle towards the front submersing bench support rail 152 at the ends and maintain a horizontal section in the middle section that contains the pivot notch 197.

In the geometry shown in FIG. 6, the translation of the support wheel 196 towards the forward portion of the support wheel groove 191 will cause a lowering of the submersing bench support rails 142, 152. The actuation of such a movement can be accomplished in a number of ways and by a number of motive forces. FIG. 6 depicts a pneumatic or hydraulic cylinder 193 which is supplied with air or fluid at the cylinder supply line 192 to drive the piston ram 194 and position the front leg 148 to the appropriate location to vary the height of the chair assembly 102. For example, when piston ram 194 is positioned at minimum stroke, the chair assembly 102 is at its highest point, and the submersing bench support rails 142, 152 align with the lateral bench support 182 and the chair support rails 126, 128 allowing the chair assembly 102 to translate across from the submersing bench assembly 106 to the wheeled base assembly 104 and back. When piston ram 194 is positioned at maximum stroke, the chair assembly 102 is at its lowest point, and the submersing bench support rails 142, 152 have disengaged from the lateral bench support 182, and the user is submersed in the water of the bathing tub 170. The cylinder supply line may be provided with pressure from a number of sources such as a manual or motorized (AC or DC) pump that has been safely positioned to isolate and electrical current from bathing water or the user.

Figure 7:
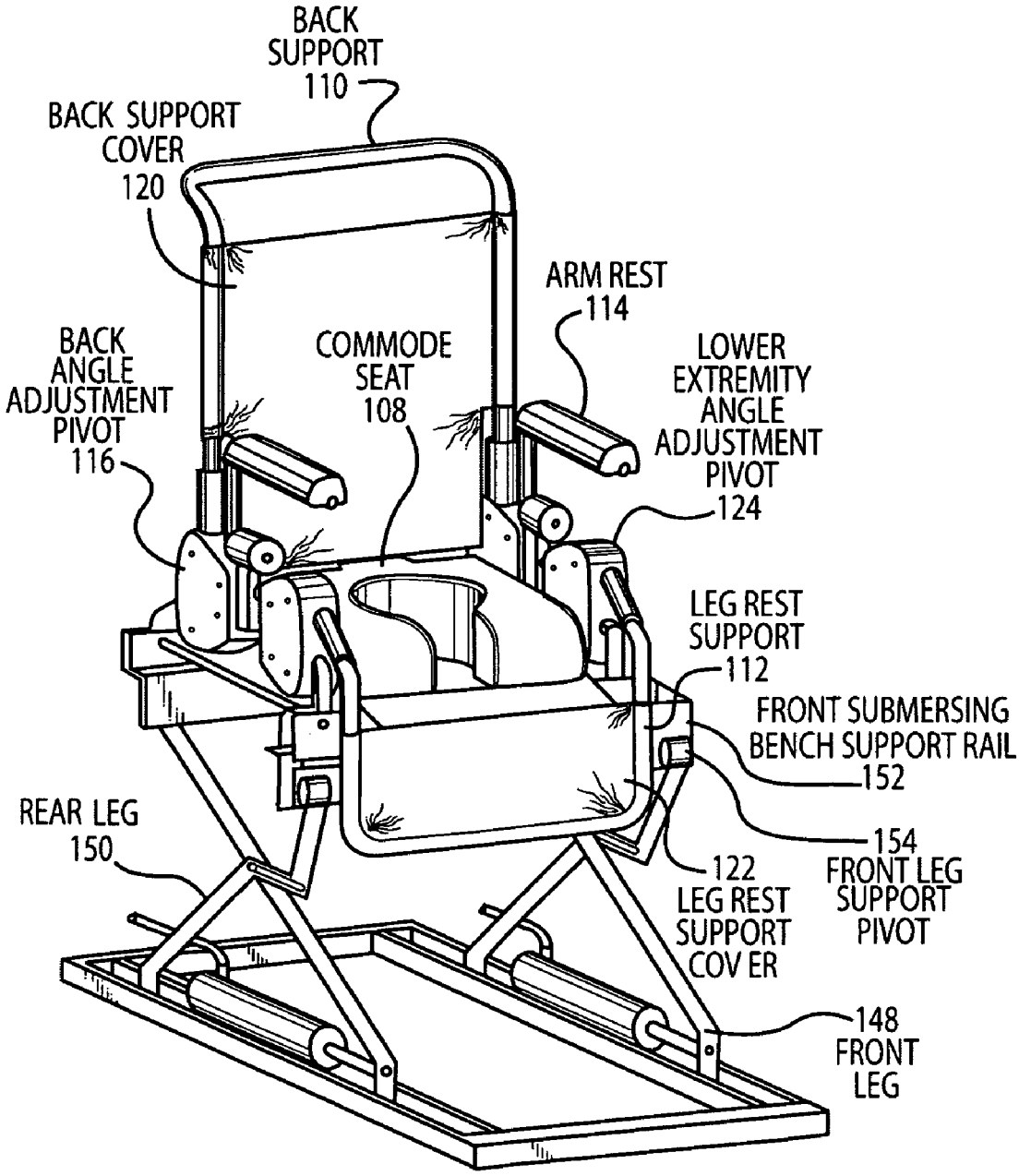
FIG. 7 is a drawing showing an embodiment of a submersing bench and chair assembly for a submersing bathing and transfer chair.

FIG. 7 is a drawing showing an embodiment of a submersing bench and chair assembly for a submersing bathing and transfer chair. As detailed in FIG. 6, the submersing base assembly 106 is in its highest position and the actuating cylinders 193 are at minimum stroke. In this configuration the chair can be independent of the wheeled base assembly 104 and/or the lateral bench support 182. The chair and bench assembly may be used independently of a bathing tub to act as a lift chair or any additional applications which may be desirous of a variable lift chair.

As similarly shown in FIG. 1, the chair assembly 102 comprises a commode seat 108, a back support 110, and a leg rest support 112 with a back angle adjustment pivot 116 on either rear lateral side of the commode seat 108. In this configuration, the angle of the back support tube 110 is variable by pivoting about the back angle adjustment pivot 116. This adjustment can be facilitated by a pivot release not shown. When the pivot release is activated the back support tube 110 can vary and lock from zero to ninety degrees. Similarly, the angle of the leg rest support tube 112 is variable by pivoting about the lower extremity angle adjustment pivot 124. This adjustment can be facilitated by a similar pivot release (not shown). When activated the leg rest support tube 112 can also vary and lock from zero to ninety degrees. On either front lateral side of the commode seat 108, a lower extremity angle adjustment pivot 124 is used to receive the leg rest support 112. The back angle adjustment pivot 116 and the lower extremity angle adjustment pivot 124 are rigidly fixed with respect to the seat chassis as well as fixed as left and right pairs by lateral chair stabilizing bars which also can support an armrest 114 on both left and right side.

Figure 8:
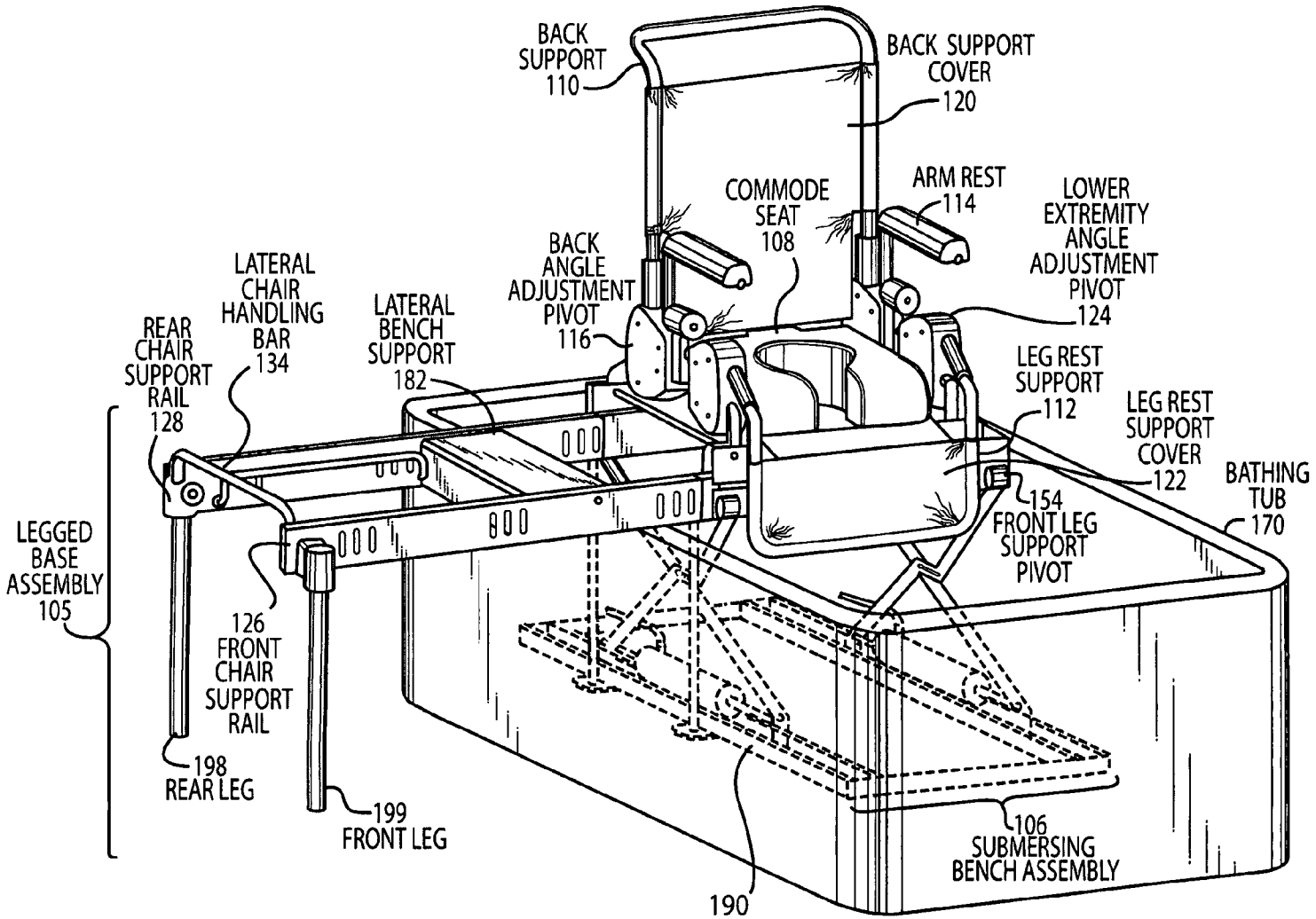
FIG. 8 is a drawing showing an embodiment of a submersing bathing and transfer chair.

FIG. 8 is a drawing showing another embodiment of a submersing bathing and transfer chair. In circumstances where it may not be necessary to utilize the chair assembly as a stand alone wheeled/commode chair, a legged base assembly 105 comprising non-wheeled supports, front leg 199 and rear leg 198, can be utilized to provide a stable platform for a transfer chair that still retains the ability to lower a user into a bathing tub 170. Additional legs may also be used to provide additional support if particular circumstances dictate. This situation might occur, for example, if there is a need for a particularly long span between the front and rear legs 199, 198 and the wall of the bathing tub 170. Additional features (not shown) may be added to the submersing bathing and transfer chair. For example, storage trays or adjustable footrests and armrests could be added to allow greater functionality and comfort to the user.

The disclosed embodiments can be manufactured in a variety of standard sizes using common components and can be custom fit for a particular individual with special needs. The lateral chair stabilizing bars position the left and right pairs of lower extremity angle adjustment pivots 124 and back angle adjustment pivots 116 such that the distance between the pivots can be varied by simply replacing the lateral chair stabilizing bars with bars of different lengths. The chair can therefore be sized to a wide variety of dimensions by simply changing the length of the lateral chair stabilizing bars and/or the transverse braces that determine seat width. This versatility allows customization of fit during the initial manufacture as well as any time throughout the life of the device. In this way, the anthropomology (specific anatomical body measurements including but not limited to size, weight, somatype, girth, physical ability and limitation, and range of motion and the like) of an individual with special needs can be addressed.

The disclosed embodiments offer the advantage of transferring an individual from a wheeled chair located outside of the bathing area to a base, which is positioned within the bathing area and lowered in an easy and safe manner to submerse the user in water for bathing. The bathing and transfer chair may include features that provide benefit to the user such as folding components to facilitate storage, auto alignment of the docking portions, adjustable or auto adjusting chair height, and safety lockout features that prevent the chair from being transferred from one side to another without proper docking of the base and bench assemblies. The chair assembly of the bathing and transfer chair can be manufactured in a variety of standard sizes using common components and can be custom fit for a particular individual with special needs. The chair can be easily sized and or resized by changing the width and length measurements on any or all of the chair support frames. Adjustments to the chair are made simple with conveniently located levers that allow the user to raise the height of the chair and make adjustments to the head and thorax portion as well as the lower extremity support.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. A bathing and transfer chair for an individual comprising:

a base assembly comprising a rigid structural base frame that supports at least one chair support rail externally of a bath tub;

a submersing bench assembly comprising a rigid structural bench frame that is supported from the bottom of a bathing tub and that supports at least one bench support rail, said submersing bench assembly being mechanically adapted to couple with said base assembly such that said at least one chair support rail aligns coaxially with said at least one bench support rail to create a glide track;

a chair assembly adapted to support an individual that can traverse said glide track between said base assembly and said submersing bench assembly; and, said submersing bench assembly can be disengaged from said base assembly and manipulated to lower the level of said chair assembly into said bathing tub.

2. The device of claim 1, wherein said base assembly further comprises a forward chair support rail and a rear chair support rail connected in an approximately parallel manner to one another by a pair of lateral base supports that forms said base frame and is supported by at least 2 legs.

3. The device of claim 2, wherein said legs of said base assembly are supported by wheels.

4. The device of claim 2, wherein said legs of said base assembly are adjustable in length.

5. The device of claim 2, wherein said legs of said base assembly are adaptable in position and orientation to said base frame.

6. The device of claim 1, wherein said submersing bench assembly further comprises a forward chair support rail and a rear chair support rail connected in an approximately parallel manner to one another by a pair of lateral base supports that forms said bench frame.

7. The device of claim 6, wherein said bench frame is supported from the base of said bathing tub by at least 2 legs.

8. The device of claim 7, wherein said bench frame is varied in height by exerting mechanical force to vary the length of said legs.

9. The device of claim 7, wherein said bench frame is varied in height by exerting mechanical force changing the position of said legs.

10. The device of claim 6, wherein said bench frame is varied in height by a mechanical force provided by pneumatic or hydraulic lift.

11. The device of claim 6, wherein said bench frame is varied in height by manual force.

12. The device of claim 6, wherein said bench frame is varied in height by electromechanical force.

13. The device of claim 1 wherein said chair assembly further comprises:

a seat portion;

a back support; and, a front chair glide rail and a rear chair glide rail connected in an approximately parallel manner to one another and adapted to engage said glide track and traverse between said base assembly and said submersing bench assembly.

14. The device of claim 13, wherein an angle of orientation of said back support to said chair assembly is adjustable.

15. The device of claim 13, wherein said chair assembly further comprises:

a leg rest support.

16. The device of claim 15, wherein said angle of orientation of said leg rest support to said chair assembly is adjustable.

17. The device of claim 13, wherein said chair assembly is customizable to fit the variations in anthropomology of an individual.

18. The device of claim 1, wherein said chair assembly is prevented from traversing said glide track unless said base assembly is coupled to said submersing bench assembly.

19. The device of claim 1, further comprising:

a lateral bench support that acts as a receiver to join said base assembly and said submersing bench assembly and that forms an intermediate support rail creating a continuous said glide track from said base assembly and said submersing bench assembly.

20. The device of claim 1, further comprising:

an alignment pin that extends from said submersing bench assembly and that mates with an alignment receiver on said base assembly to align and facilitate docking said base assembly with said submersing bench assembly.

21. The device of claim 1, further comprising:

a first alignment pin that extends from said submersing bench assembly and that mates with a first alignment receiver on said lateral bench to align and facilitate docking said lateral bench with said submersing bench assembly; and, a second alignment pin that extends from said base assembly and that mates with a second alignment receiver on said lateral bench to align and facilitate docking said lateral bench with said base assembly.

22. A bathing and transfer chair for an individual comprising:

a wheeled base assembly comprising a rigid structural base frame and at least one chair support rail, said base frame being supported exterior of said tub by at least three wheeled legs;

a submersing bench assembly comprising a rigid structural bench frame and at least one bench support rail, said bench frame is supported from the bottom of a bathing tub and being supported by at least one leg, said submersing bench assembly being mechanically adapted to couple with said wheeled base assembly such that said at least one chair support rail aligns coaxially with said at least one bench support rails to create a glide track;

a chair assembly adapted to support an individual that may independently rest upon said wheeled base assembly or said submersing bench assembly, said chair assembly can traverse said glide track between said wheeled base assembly and said submersing bench assembly; and, said submersing bench assembly can be disengaged from said base assembly and manipulated to lower the level of said chair assembly into said bathing tub.

23. The device of claim 22, wherein said wheeled base assembly further comprises a forward chair support rail and a rear chair support rail connected in an approximately parallel manner to one another by a pair of lateral base supports that forms said base frame.

24. The device of claim 22, wherein said wheeled legs of said wheeled base assembly are adjustable in length.

25. The device of claim 22, wherein said wheeled legs of said base assembly are adaptable in position and orientation to said base frame.

26. The device of claim 22, wherein said submersing bench assembly further comprises a forward chair support rail and a rear chair support rail connected in an approximately parallel manner to one another by a pair of lateral base supports that forms said bench frame.

27. The device of claim 22, wherein said bench frame is varied in height by exerting mechanical force to vary the length of at least one said leg.

28. The device of claim 22, wherein said bench frame is varied in height by exerting mechanical force changing the position of at least one said leg.

29. The device of claim 22, wherein said bench frame is varied in height by a mechanical force provided by pneumatic or hydraulic lift.

30. The device of claim 22, wherein said bench frame is varied in height by manual force.

31. The device of claim 22, wherein said bench frame is varied in height by electromechanical force.

32. The device of claim 22 wherein said chair assembly further comprises:

seat portion;

a back support; and, a front chair glide rail and a rear chair glide rail connected in an approximately parallel manner to one another and adapted to engage said glide track and traverse between said base assembly and said submersing bench assembly.

33. The device of claim 32, wherein an angle of orientation of said back support to said chair assembly is adjustable.

34. The device of claim 32, wherein said chair assembly further comprises:

a leg rest support.

35. The device of claim 34, wherein said angle of orientation of said leg rest support to said chair assembly is adjustable.

36. The device of claim 32, wherein said chair assembly is customizable to fit the variations in anthropomology of an individual.

37. The device of claim 22, wherein said chair assembly is prevented from traversing said glide track unless said base assembly is coupled to said submersing bench assembly.

38. The device of claim 22, further comprising:

an alignment pin that extends from said submersing bench assembly and that mates with an alignment receiver on said base assembly to align and facilitate docking said base assembly with said submersing bench assembly.

* * * * *